US011466551B2

(12) United States Patent
Williams et al.

(10) Patent No.: US 11,466,551 B2
(45) Date of Patent: Oct. 11, 2022

(54) METHODS FOR WELL COMPLETION

(71) Applicant: SCHLUMBERGER TECHNOLOGY CORPORATION, Sugar Land, TX (US)

(72) Inventors: Harvey Williams, Houston, TX (US); Jeremy P. Harvey, Houston, TX (US); Andrew J. Martin, Cambridge (GB); Iain Cooper, Houston, TX (US); J. Ernest Brown, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/105,111

(22) PCT Filed: Dec. 16, 2014

(86) PCT No.: PCT/US2014/070536

§ 371 (c)(1),
(2) Date: Jun. 16, 2016

(87) PCT Pub. No.: WO2015/095155

PCT Pub. Date: Jun. 25, 2015

(65) Prior Publication Data

US 2016/0319651 A1 Nov. 3, 2016

Related U.S. Application Data

(60) Provisional application No. 61/916,733, filed on Dec. 16, 2013.

(51) Int. Cl.
*E21B 43/26* (2006.01)
*E21B 43/11* (2006.01)
(Continued)

(52) U.S. Cl.
CPC ..... *E21B 43/261* (2013.01); *E21B 29/02* (2013.01); *E21B 37/10* (2013.01); *E21B 43/11* (2013.01);
(Continued)

(58) Field of Classification Search
CPC .... E21B 43/261; E21B 43/116; E21B 43/166; E21B 43/11; E21B 43/26; E21B 43/16;
(Continued)

(56) References Cited

U.S. PATENT DOCUMENTS 2,771,960 A * 11/1956 Smith ..... G01V 1/52 102/301
3,820,604 A * 6/1974 Karnes ..... E21B 43/11 166/297
(Continued)

FOREIGN PATENT DOCUMENTS

WO 2001007860 A2 2/2001
WO 2012064356 A1 5/2012

OTHER PUBLICATIONS

International Search Report and Written Opinion issued in PCT/US2014/070536 dated Apr. 6, 2015; 21 pages.

*Primary Examiner* — George S Gray
(74) *Attorney, Agent, or Firm* — Michael L. Flynn

(57) ABSTRACT

A downhole tool assembly for completing or cleaning a wellbore. The downhole tool assembly may include a perforation gun sub and a laser assembly sub. The perforation gun sub may be used to propagate a shockwave through one or more pre-existing perforations in a formation. The laser assembly sub may be used for treating perforations, e.g. treating the one or more pre-existing perforations. Depending on the parameters of the operation, the treating of the
(Continued)

perforations may comprise changing the shape of the perforations and/or making the perforations wider, deeper, or otherwise adjusted.

11 Claims, 8 Drawing Sheets

(51) Int. Cl.

| | |
|---|---|
| ***E21B 37/10*** | (2006.01) |
| ***E21B 47/107*** | (2012.01) |
| ***E21B 29/02*** | (2006.01) |
| ***E21B 43/116*** | (2006.01) |
| ***E21B 43/16*** | (2006.01) |
| ***E21B 21/08*** | (2006.01) |

(52) U.S. Cl.
CPC ..... *E21B 43/116* (2013.01); *E21B 43/166* (2013.01); *E21B 47/107* (2020.05); *E21B 21/085* (2020.05)

(58) Field of Classification Search
CPC .... E21B 43/1195; E21B 43/04; E21B 43/117; E21B 47/101; E21B 29/02; E21B 37/10; E21B 37/08; E21B 2021/006; E21B 21/00; E21B 49/08; E21B 2034/002; E21B 7/14; E21B 36/04; E21B 28/00; E21B 43/003; E21B 43/0092; E21B 47/104; E21B 21/08; E21B 21/085; E21B 47/107; F42D 5/045; F42B 3/02
See application file for complete search history.

(56) References Cited

U.S. PATENT DOCUMENTS

| | | | | |
|---|---|---|---|---|
| 5,669,448 | A * | 9/1997 | Minthorn | E21B 33/12 166/177.5 |
| 6,732,798 | B2 | 5/2004 | Johnson et al. | |
| 9,242,309 | B2 | 1/2016 | Zediker et al. | |
| 2004/0159432 | A1 | 8/2004 | Johnson et al. | |
| 2004/0256103 | A1* | 12/2004 | Batarseh | B23K 26/0648 166/297 |
| 2005/0217854 | A1* | 10/2005 | Hayes | E21B 37/00 166/297 |
| 2007/0158109 | A1 | 7/2007 | Zazovsky et al. | |
| 2009/0195244 | A1 | 8/2009 | Mouget et al. | |
| 2010/0326659 | A1 | 12/2010 | Schultz et al. | |
| 2012/0074110 | A1* | 3/2012 | Zediker | B08B 7/0042 219/121.72 |
| 2012/0217018 | A1* | 8/2012 | Zediker | E21B 33/063 166/361 |
| 2013/0228372 | A1* | 9/2013 | Linyaev | E21B 7/15 175/16 |
| 2014/0305877 | A1* | 10/2014 | Cioanta | E21B 28/00 210/739 |

* cited by examiner

METHODS FOR WELL COMPLETION

CROSS-REFERENCE TO RELATED APPLICATIONS

This application is a 35 U.S.C. § 371 National Phase of International Patent Application No. PCT/US2014/070536, filed Dec. 16, 2014, which claims the benefit of U.S. Provisional Application No. 61/916,733, entitled "METHODS FOR WELL COMPLETION" filed Dec. 16, 2013, the entire disclosures of which are hereby incorporated herein by reference.

BACKGROUND OF INVENTION

The fluid communication between an oil or gas reservoirs and the wellbore where the oil or gas will be produced to the surface is often enhanced by perforation tunnels in the formation. The perforations are created at the location of the producing formation, and they typically extend perpendicularly into the formation. Perforation tunnels are typically made using shaped explosive charges that inject a material into the formation, creating the tunnel. Lately, a new method has been developed where the perforation tunnels are created with a downhole laser.

In conventional perforating, the explosive nature of the process shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties and so forth. The shock damaged region and loose debris in the perforation tunnels may impair the productivity of production wells or the injectivity of injector wells.

To address these issues, pressure in a wellbore interval is manipulated in relation to the reservoir or surrounding formation pore pressure to achieve removal of debris from perforation tunnels. The pressure manipulation includes creating an underbalanced condition in the wellbore, where the formation pressure is higher than the pressure in the wellbore. For example, a lighter fluid may be pumped into an isolated region of the wellbore creating a lower pressure in the wellbore. In another example, a transient underbalanced condition may be created in the wellbore. Creation of an under-balance condition can be accomplished in a number of different ways, such as by use of a low pressure chamber that is opened to create the transient underbalance condition, the use of empty space in a perforating gun or tube to draw pressure into the gun right after firing of shaped charges, and other techniques. The underbalanced condition results in a suction force that will extract debris out of the perforation tunnels and fluid from the wellbore into the tube enabling the well to flow more effectively or more efficient injection of fluids into the surrounding formation. Creation of an overbalance condition can be accomplished by use of a propellant (which when detonated causes high pressure gas buildup), a pressurized chamber, or other techniques. The burning of the propellant can cause pressure to increase to a sufficiently high level to fracture the formation. The fracturing allows for better communication of reservoir fluids from the formation into the wellbore or the injection of fluids into the surrounding formation.

Examples of transient underbalanced perforating are shown in U.S. Pat. No. 6,732,798, assigned to the assignee of this application and incorporated by reference herein in its entirety.

The manipulation of wellbore pressure conditions causes at least one of the following to be performed: (1) enhance transport of debris (such as sand, rock particles, etc.) from perforation tunnels; (2) achieve near-wellbore stimulation; and (3) perform fracturing of surrounding formation.

During the manipulation of pressure, one or more packers or plugs are positioned between the inside of the wellbore and the outside of the perforating gun or tube to isolate the interval over which the detonation or explosion takes place to achieve a quicker, confined, and amplified response for the underbalance or overbalance effect. In another example, a static or transient underbalanced condition may be created in an open (i.e., not packed off) wellbore.

Referring now to the drawings, FIG. 1 illustrates a typical well installation 10 including a wellbore 12 normally containing borehole fluid 14. As is well known, the wellbore 12 has a surrounding casing 16 and cement 18 between the casing 16 and the surrounding surface formation 20 that holds the casing 16 in place. A wellhead 22 at the top of the surface formation 20 has an open bottom tubing 24 that extends downwardly into an upper portion of the wellbore 12. In the well installation 10 illustrated, the surface formation 20 includes an area of caprock 26, a damaged formation 28 and an undamaged formation 30, all of which surround cement 18. Perforation tunnels 32 extend through the casing 16 and cement 18 into the damage formation 28 at one or more desired formation zones 33. It is also known in the art to perforate open-hole wellbores; that is, a section of a wellbore that does not have a casing (not shown).

The perforation tunnels 32 are previously formed using a perforating gun string to allow fluid flow from the formation zones 33 to flow into the well for production to the surface, or to allow stimulating injection fluids to be applied to the formation zones. The explosive nature of the formation of the perforation tunnels 32 shatters the sand grains in the damaged formation 28 and typically generates tunnels 32 full of rock debris mixed in with perforator charge debris. Such debris is known to impair the productivity of production wells and negatively impact upon the flow of formation fluids in the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An example of a downhole tool assembly for completing or cleaning a wellbore includes a perforation gun sub and a laser assembly sub.

An example of a method for completing a wellbore includes perforating a formation with a perforating gun to create one or more perforations in the formation and treating one or more of the perforations with a laser.

An example of a method for conditioning a wellbore includes propagating a shock wave through one or more pre-existing perforations in a formation with a perforating gun and treating one or more of the perforations with a laser.

An example of a method for performing a wellbore operation includes disposing a fluid pill within a wellbore, the fluid pill including a laser-activatable component, and contacting the fluid pill with laser energy, thereby activating the laser-activatable component, altering a character of the fluid pill.

An example of a method for conditioning a wellbore includes disposing a downhole tool comprising a laser assembly in a wellbore proximate existing perforations in a formation, aligning the laser assembly proximate one of the perforations, and treating one or more of the perforations with a laser generated by the laser assembly.

An example of a method for improving an existing perforation includes lowering a laser system into a wellbore, locating an existing perforation tunnel, align a laser device in the laser system with the existing perforation tunnel, and energize the laser device to perform an operation on the perforation tunnel.

An example of a perforating method includes using a laser system to cut one or more perforations into a formation and creating an underbalanced condition in the wellbore.

Other aspects and advantages of the claimed subject matter will be apparent from the following description and the appended claims.

DETAILED DESCRIPTION

In the following description, certain terms have been used for brevity, clearness, and understanding. No unnecessary limitations are implied beyond the requirement of prior art because such terms are used for descriptive purposes and are intended to be broadly construed. The different configurations and methods described herein may be used alone or in combination with other configurations, systems, and methods. It is to be expected that various equivalents, alternatives, and modifications are possible within the scope of the appended claims.

In general, the embodiments of the present disclosure relate to systems, methods and tools to establish and enhance fluid communication between the hydrocarbon reservoir in the formation and the well bore. In particular, the embodiments of the present disclosure relate to high power laser tools for perforating, fracturing, and opening, increasing and enhancing the flow of energy sources, such as hydrocarbons and geothermal, from a formation into a production tubing or collection system.

In general, and by way of illustration, a laser perforating tool may have several components or sections. The tool may have one or more of these and similar types of sections: a conveyance structure, a guide assembly, a cable head, a roller section, a casing collar locating section, a swivel, a LWD/MWD section, a vertical positioning section, a tractor, a packer or packer section, an alignment or orientation section, laser directing aiming section, and a laser head. These components or sections may be arranged in different orders and positions going from top to bottom of the tool. In general and unless specified otherwise, the bottom of the tool is that end which first enters the borehole and the top of the tool is that section which last enters the borehole and typically is attached to or first receives the conveyance structure. It is further understood that one component in the tool may perform the functions of two or more other components; that the functions of a single component may be performed by one, two or more components; and combinations and variations of these.

Figure 7:
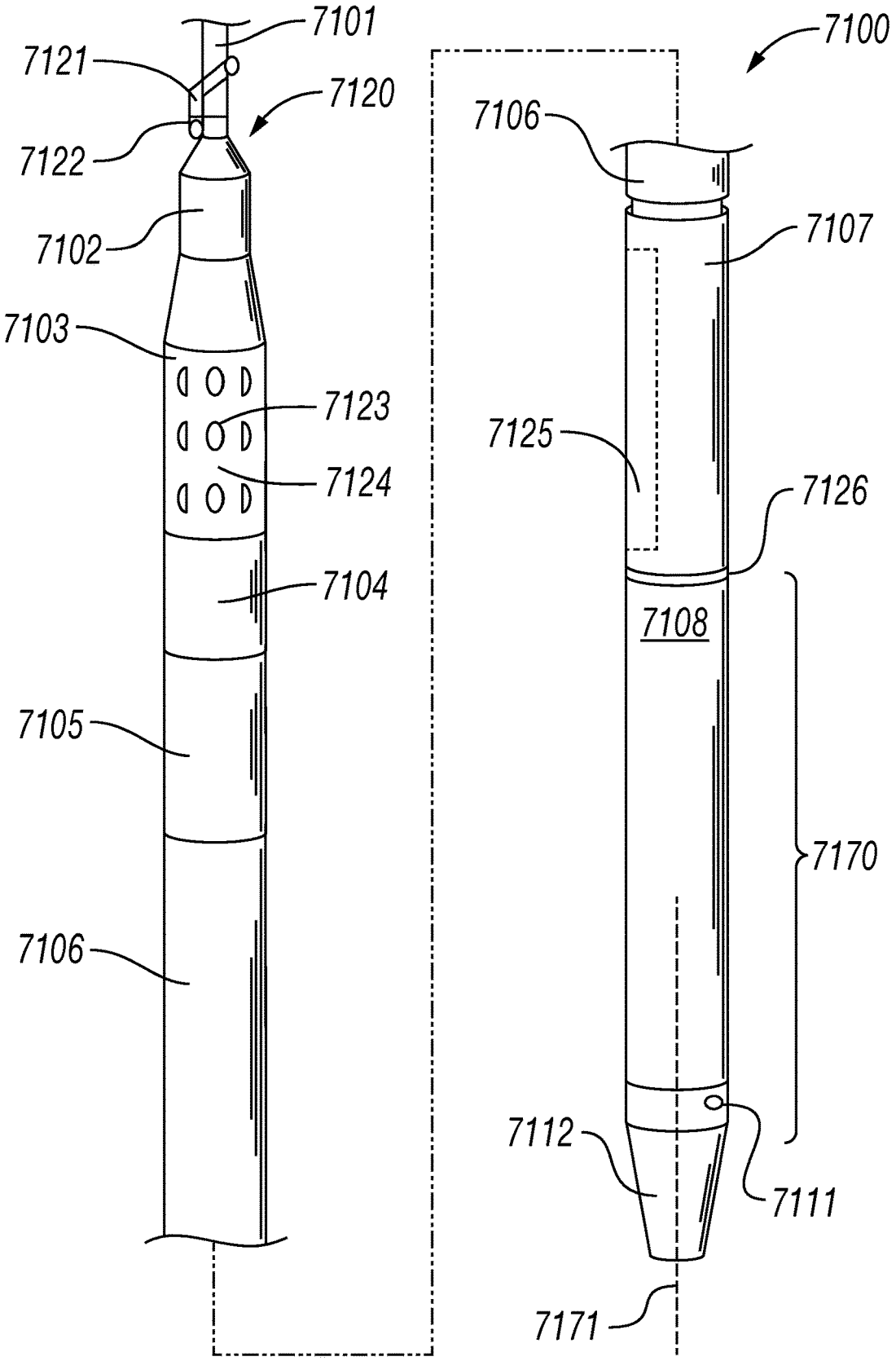
FIG. 7 is a perspective view of an embodiment of a laser assembly according to the present disclosure.
Figure 7A:
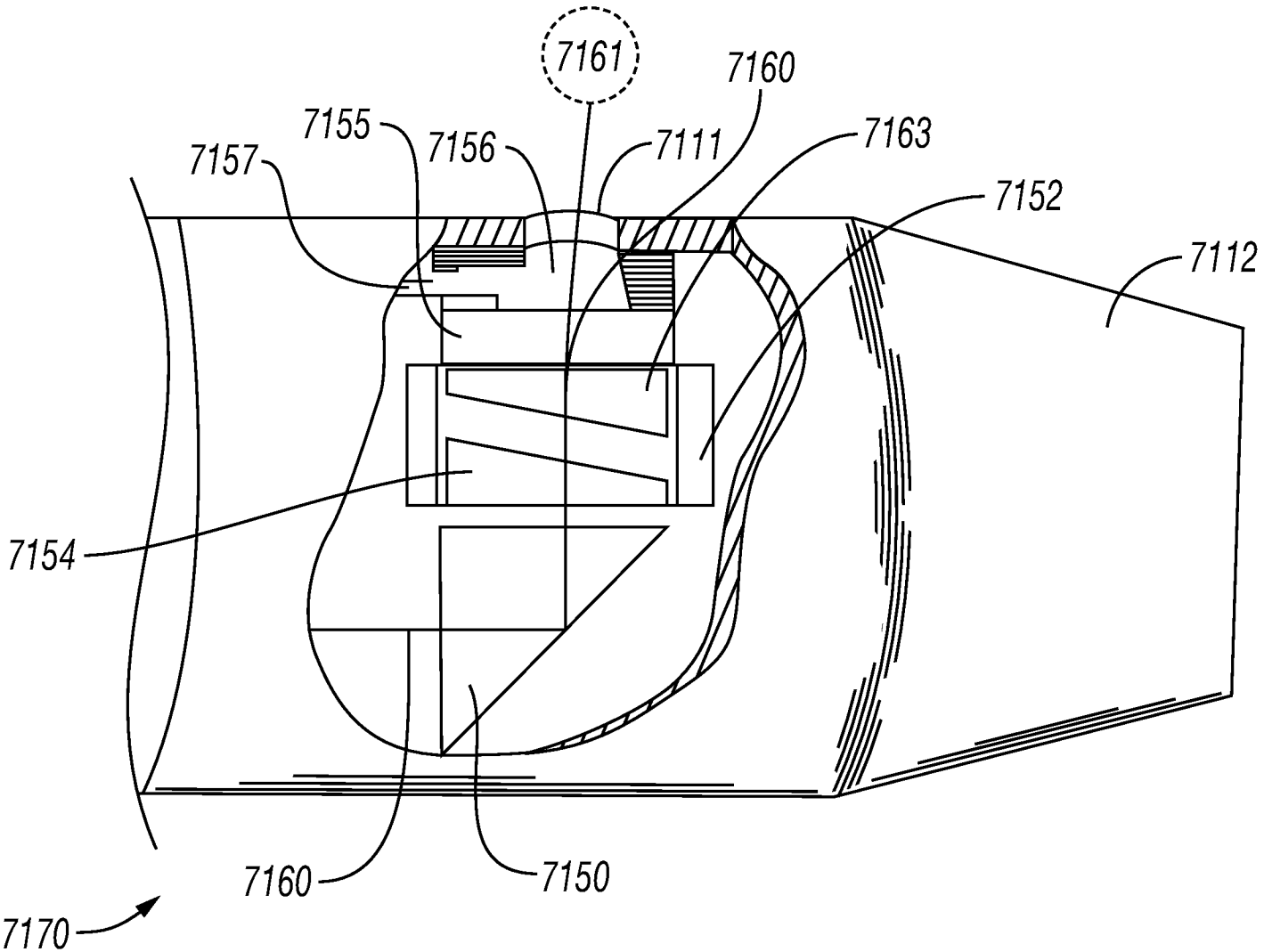
FIG. 7A is a cutaway perspective view of an embodiment of the laser assembly according to the present disclosure.

Turning to FIGS. 7 and 7A, one example of a tool associated with laser perforating is shown based on the description in U.S. Patent Publication No. 2013/0228372. Other specific tools may be used in connection with the methods described in this specification. The laser perforating tool 7100 contains several connectable and cooperatively operable subassemblies forming an elongated housing that may be joined together by threaded unions, or other connecting means know to the art, into an operable piece of equipment for use. At the top 7120 of tool 7100 is a conveyance structure 7101, which is mounted with the tool 7100 at a cable head 7102. A guide assembly 7121 is mounted around conveyance structure 7101 immediately above cable head 7102.

Housing guide assembly 7121 is freely rotatedly mounted around the conveyance structure 7101 and provided with a roller or wheel and a sliding shoe or guide portion 7122 which enables the tool to be pulled into a reduced diameter aperture such as when the tool is pulled from a lower portion of well casing through a bulkhead or the like into a shorter tubing string. Adjacent cable head 7102 is upper roller assembly 7103. Upper roller assembly 7103 contains a number of individual rollers, e.g., 7123 mounted in a space relation around and longitudinally along this section.

Below casing collar locator 7105 is a swivel sub 7106. Swivel sub 7106 is constructed with overlapping internal and external members that provide for a rigid longitudinal connection between upper and lower portions of the housing while at the same time providing for free rotational movement between adjoining upper and lower portions of the housing.

Below swivel sub 7106 in the housing may be an eccentrically weighted sub 7107, which provides for passive vertical orientation, positioning, of the laser sub assembly 7170. Eccentric weight sub 7107 contains a substantially dense weight, such as depleted uranium, that is positioned in an eccentric relation to the longitudinal axis of the housing. This eccentric weight 7125 is illustrated in dashed lines in its eccentric position relative to the longitudinal axis of this sub. The position of eccentric weight 7125 is on what will be referred to as the bottom portion of the housing proximate the laser sub 7170. Due to the mass of eccentric weight 7125 being selected as substantially larger than the mass of the adjacent portion of the apparatus housing, this weight will cause the housing to rotate to an orientation placing weight 7125 in a downwardly oriented direction. This is facilitated by the presence of swivel sub 7106. Immediately below eccentric weight sub 7107 is an alignment joint sub indicated at 7126. Alignment joint 7126 is used to correctly connect eccentric weight sub 7107 with the laser sub 7170 so that the bottom portion of the housing will be in alignment with the laser beam aiming and directing systems in the laser sub 7170.

Laser sub assembly 7170 contains several components within its housing 7108. These components or assemblies may include controllers, circuitry, motors and sensors for operating and monitoring the delivery of the laser beam, an optics assembly for shaping and focusing the laser beam, a beam aiming and directing assembly for precisely directing the laser beam to a predetermined location within the borehole and in a predetermined orientation with respect to the axis 7171 of the laser sub 7170, the beam aiming and directing system may also contain a beam path verification system to make certain that the laser beam has a free path to the casing wall or structure to be perforated and does not inadvertently cut through a second string or other structure located within the casing, a laser cutting head which is operably associated with, or includes, in whole or in part, the optics assembly and the beam aiming and directing assembly components, a laser beam launch opening 7111, and an end cone 7112. The laser sub 7170 may also contain a roller section or other section to assist in the movement of the tool through the borehole.

Other suitable laser structures are shown, for example, in U.S. Patent Publication No. 2013/0228372.

Turning to FIG. 7A there is shown a cut away perspective view of the laser perforating subassembly 7170. The laser beam traveling along beam path 7160, from optics assembly (not shown in the Figure) enters TIR prism 7150 (Total internal reflection (TIR) prisms, and their use in high power laser tools is taught and disclosed in U.S. patent application Ser. No. 13/768,149, the entire disclosure of which is incorporated herein by reference). It is noted that other forms of mirrors and reflective surfaces may be used. From TIR prism 7150 the laser beam traveling along beam path 7160 enters a pair of optical wedges 7163, 7154, which are commonly called Risley Prisms, and which are held and controlled by Risley Prism mechanism 7152. As the prisms are rotated about the axis of the laser beam path 7160 they will have the effect of steering the laser beam, such that depending upon the relative positions of the prisms 7163, 7154 the laser beam can be directed to any point in area 7161 and can be moved in any pattern within that area. There is further provided a window 7155 that is adjacent a nozzle assembly 7156 that has a source of a fluid 7157.

The conveyance structure transmits high power laser energy from the laser to a location where high power laser energy is to be utilized or a high power laser activity is to be performed by, for example, a high power laser tool. The conveyance structure may also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

The method of conveyance may be any conveyance known in the art, such as wireline, slickline, coiled tubing, drill pipe, and a tractor.

Figure 8:
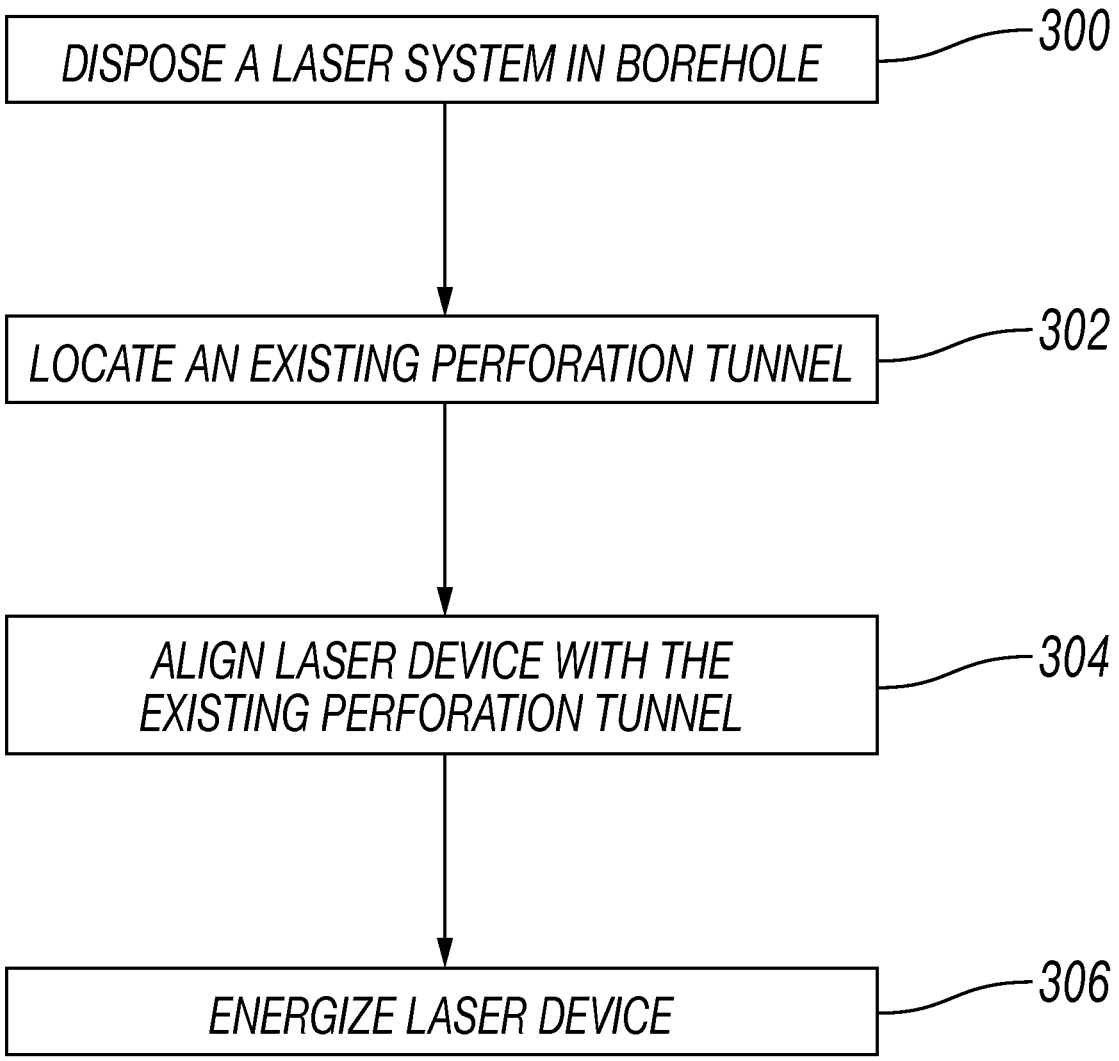
FIG. 8 is a flowchart illustrating a method in accordance with the present disclosure.

Turning to FIG. 8, a method in accordance with an embodiment of the present disclosure is shown. First, a laser assembly as described above is disposed in a previously perforated borehole 300. In this embodiment, the previously perforated borehole was perforated by an explosive perforation gun. The laser assembly may be a laser system that includes a laser device. They laser system may also include a locating device to locate existing perforations. Such locating devices may include the laser device operating in a low-power mode, a sonic tool, an ultrasonic tool, a mechanical caliper, or any other device for locating downhole features. The locating device may be engaged to locate an existing perforation 302. Next, the laser device may be aligned with the existing perforation. 304. The laser assembly is then energized to further cut the perforation tunnels 306. One example of an ultrasonic tool is disclosed in U.S. Patent Publication No. 2009/0195244 (assigned to the assignee of the present disclosure, and which is incorporated by reference in its entirety).

With respect to cutting the perforating tunnels 306, the laser assembly may be used in a number of ways to improve the quality of the perforating tunnels (by reducing debris, for example). For example, the laser assembly may be used to cut the tunnels in a specific, time-dependent pattern to allow for gas injection coincident with the laser, to assist with debris removal. In an embodiment, the laser assembly may be held at a constant measured depth, while oscillating the laser assembly azimuthally over a defined angular range. In an embodiment, the azimuthal direction could be held constant while the laser assembly is oscillated axially in the wellbore parallel to an axis of the wellbore. In an embodiment, the laser assembly could be oscillated in a spiral shape, starting from the inside and moving concentrically out to a minimum radial dimension, then reversing the path to cut back to the center of the perforation tunnel, and repeating this operation as desired.

The laser assembly in accordance with the present disclosure may also be used in conjunction with a packed off region around the perforating interval with pressure valves to control the pressure when gas is injected. In addition, specifically controlled underbalance (wellbore to formation) may be employed to enhance the removal perforation debris. This process is described in more detail below.

Figure 1:
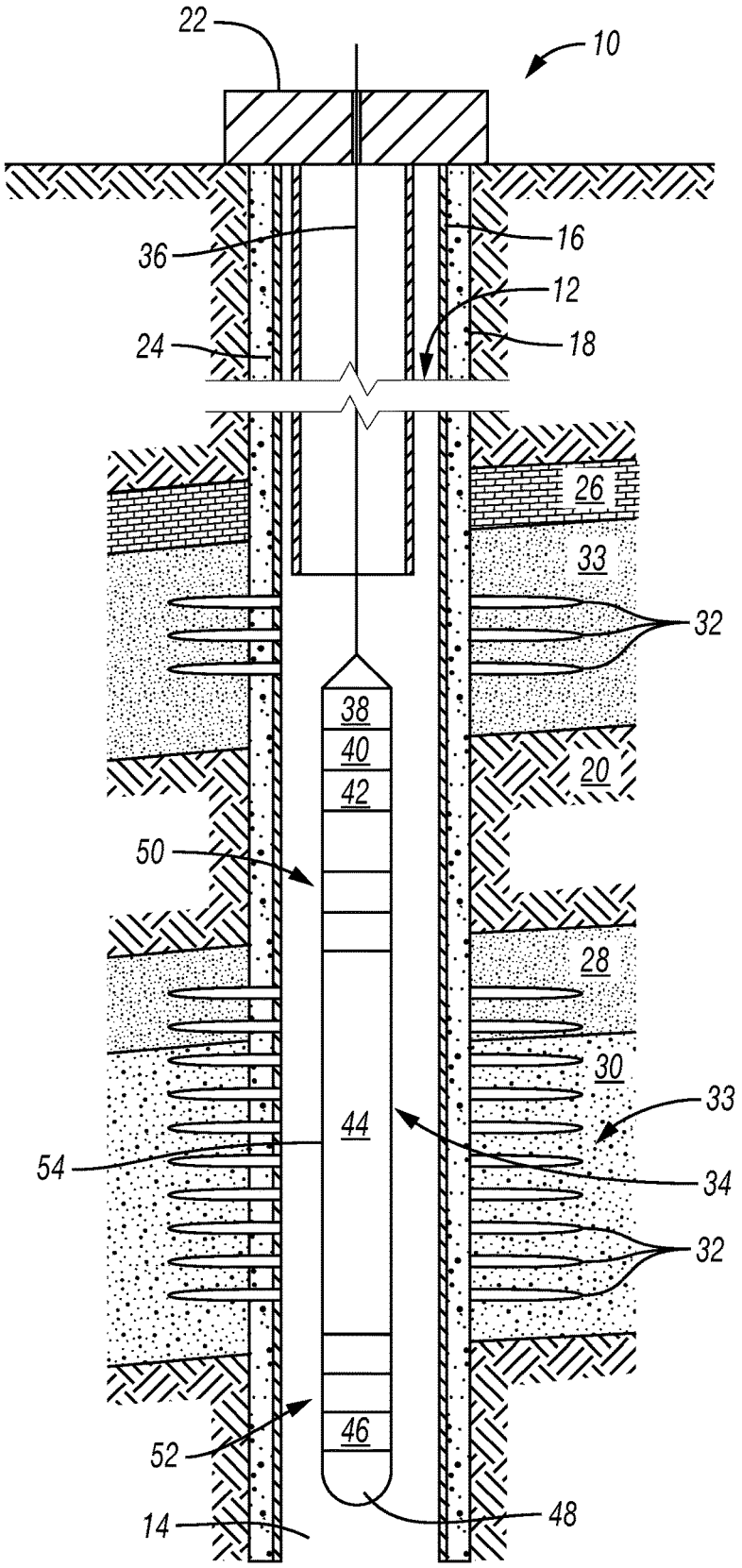
FIG. 1 is a sectional view of a well formation having a wellbore provided with a downhole tool assembly according to the present disclosure.
Figure 2:
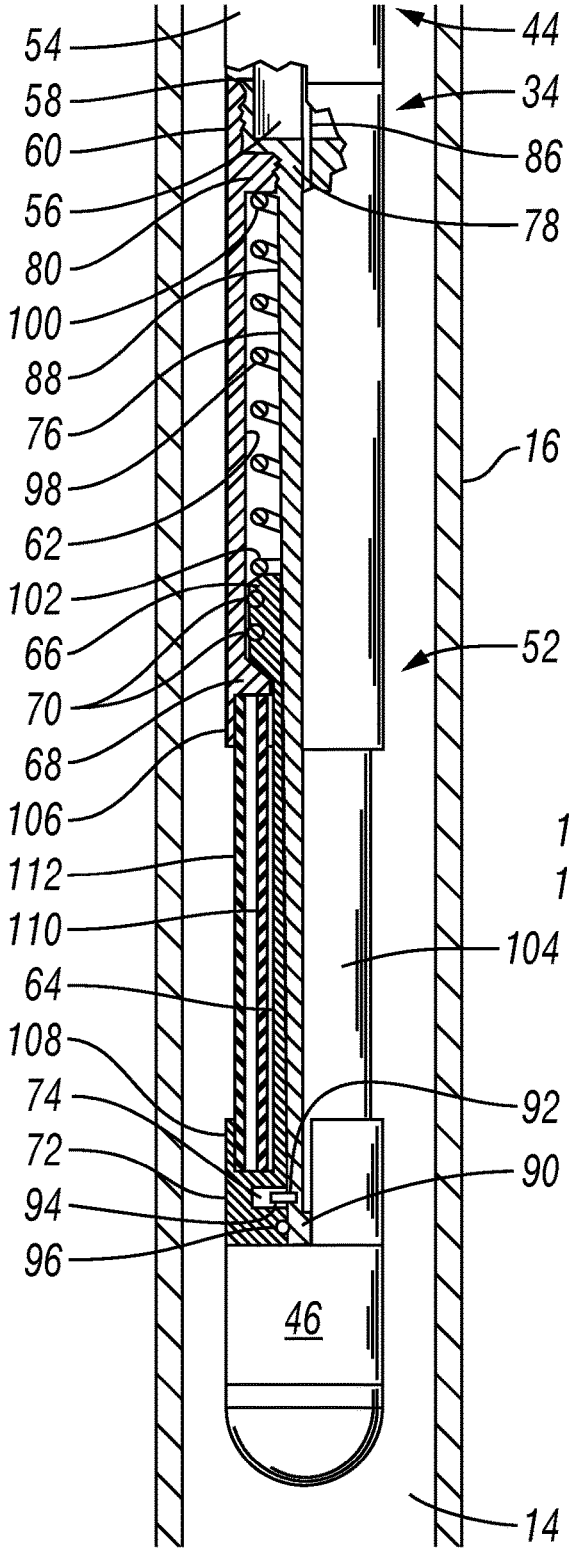
FIG. 2 is an enlarged fragmentary sectional view of a lower portion of FIG. 1 in an unfired condition with certain portions of the structure surrounding the wellbore being omitted for simplicity.
Figure 3:
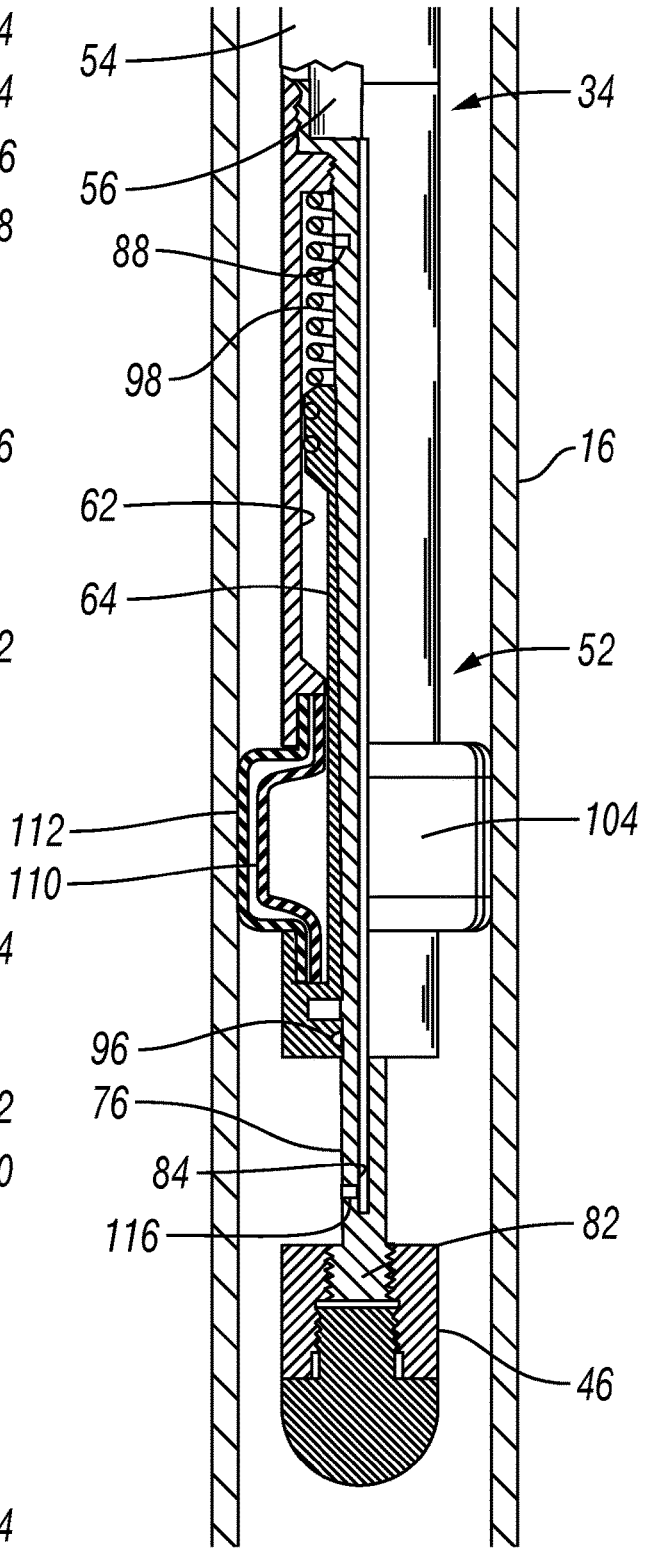
FIG. 3 is an enlarged fragmentary sectional view similar to FIG. 2 showing the downhole tool assembly during a tired condition.

Referring now to FIGS. 1-3, the downhole tool 44, such as a perforating gun, has an elongated tubular body 54 which is generally cylindrical in cross section. It can be appreciated from FIG. 1, that downhole tool 44 as well as head 38, casing collar locator 40, firing head 42, the upper and lower plug assemblies 50, 52 and the connector 46 each have substantially similar cylindrical shape and outer diameters which will permit the insertion and extraction of assembly 34 relative to wellbore 12. The tubular body 54, when positioned in the downhole tool assembly 34, defines a sealed internal underbalance chamber 56 (FIGS. 2 and 3) which typically contains only air at atmospheric pressure such as that set at the well surface for insertion into the wellbore 12. Air at atmospheric pressure provides an internal chamber pressure which is significantly less than the wellbore pressure encountered at a formation zone 33 or the formation pore pressure.

As seen in FIG. 2, the tubular body 54 has a trunk 58 which is threadably connected to an upper end 60 of elongated hollow cylinder 62 that extends from the body 54. An elongated hollow piston 64 is disposed for sliding movement back and forth inside the cylinder 62. The piston 64 has an enlarged upper end 66 that normally is positioned against a lower end 68 of the cylinder 62 when the assembly 34 is in the unfired condition in the wellbore 12. A pair of annular O-rings or seals 70 is provided between the inner surface of cylinder 62 and the outer surface of the piston upper end 66. A lower end 72 of the piston 64 is formed with a central recess 74, and is normally disposed upon the top of connector 46 when the assembly 34 is in the unfired condition.

The piston 64 slides back and forth upon an elongated hollow mandrel 76 that has a top end 78 threadably secured to a neck portion 80 of a cylinder 62 such that the mandrel 76 extends through the center of the cylinder 62 and lies inwardly of the piston 64. As seen from FIG. 3, a lower end 82 of the mandrel 76 is threadably attached to the connector 46. The mandrel 76 is formed with a vertically extending passageway 84 (FIG. 3) which opens into tubular body 54, and is designed to hold a laser assembly 86 that extends between the firing head 42 and the lower end 72 of piston 64 when assembly 34 is in the unfired condition. Passageway 84 may contain electrical connections.

An upper portion of mandrel 76 is constructed with a vent 88 that communicates with an interior of cylinder 62. A lower end 90 of the mandrel 76 is provided with an opening 92 for retaining a rupture element, electrical release or shear disk 94 that normally extends radially into the piston recess 74 when the assembly 34 is in the unfired condition. An annular O-ring or seal 96 is provided between the lower end 90 of mandrel 76 and the lower end 72 of piston 64. A coil spring 98 surrounds the mandrel 76 and lies inwardly of the inner surface of cylinder 62. The spring has a top end 100 engaged against the neck portion 80 of the cylinder 62, and a bottom end 102 engaged against the upper end 66 of piston 64.

The lower plug assembly 52 (as well as the upper plug assembly 50) typically includes a flexible, elastomeric production packer or plug element 104 which is expandable and collapsible. The plug element 104 is generally designed to be temperature, chemical and tear resistant as well as extremely elastic. As seen in FIG. 2, the plug element 104 surrounds the piston 64 and extends between the cylinder 62 and the piston 64. More particularly, a top end 106 of the plug element 104 is attached to a recessed portion at the lower end 68 of cylinder 62. A bottom end 108 of the plug element 104 is secured to a recessed portion at the lower end 72 of piston 64. In the example shown, the plug element 104 has an inner layer 110 and an outer layer 112.

As will be explained in greater detail below, the foregoing construction generally provides that each plug element 104 is movable between collapsed and expanded states or positions relative to the inside of casing 16 by virtue of sliding movement of piston 64 relative to the cylinder 62 and the mandrel 76.

Figure 4:
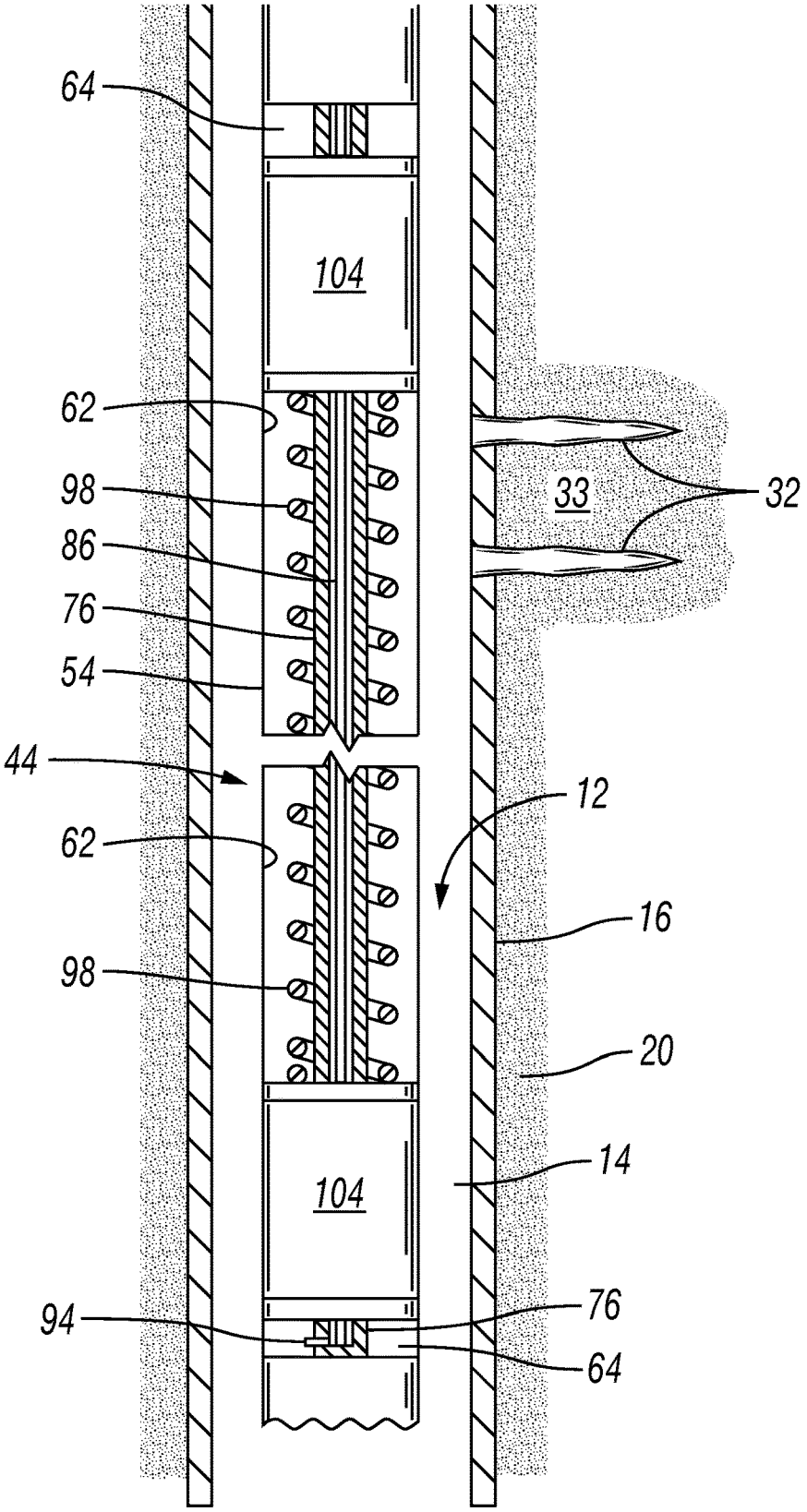
FIG. 4 is a representation of the downhole tool assembly of FIG. 1.

The operation of the downhole tool assembly 34 of the present disclosure will now be described, with initial reference to FIGS. 1 and 4 which show the tool 44 suspended in the wellbore 12 containing borehole fluid 14 and positioned adjacent a formation zone 33 having a series of previously formed perforation tunnels 32 filled with damage and debris. The tool 44 is in the installed or unfired condition as described above with internal chamber 56 (FIG. 1) of the tool 44 being at atmospheric pressure which is significantly lower than the pressure in the surrounding wellbore 12 and the pore pressure of surrounding formation 20. The lower pressure in internal chamber 56 is in communication with the top of each piston 64 via the mandrel passageway 84 and the vent 88. Each piston 64 is prevented from slidably moving along its mandrel 76 towards the low pressure in chamber 56 by the engagement of the ruptured disk 94 in the mandrel 76 and, to some extent, by the spring 98 which is normally biased against the top of piston 64.

Figure 5:
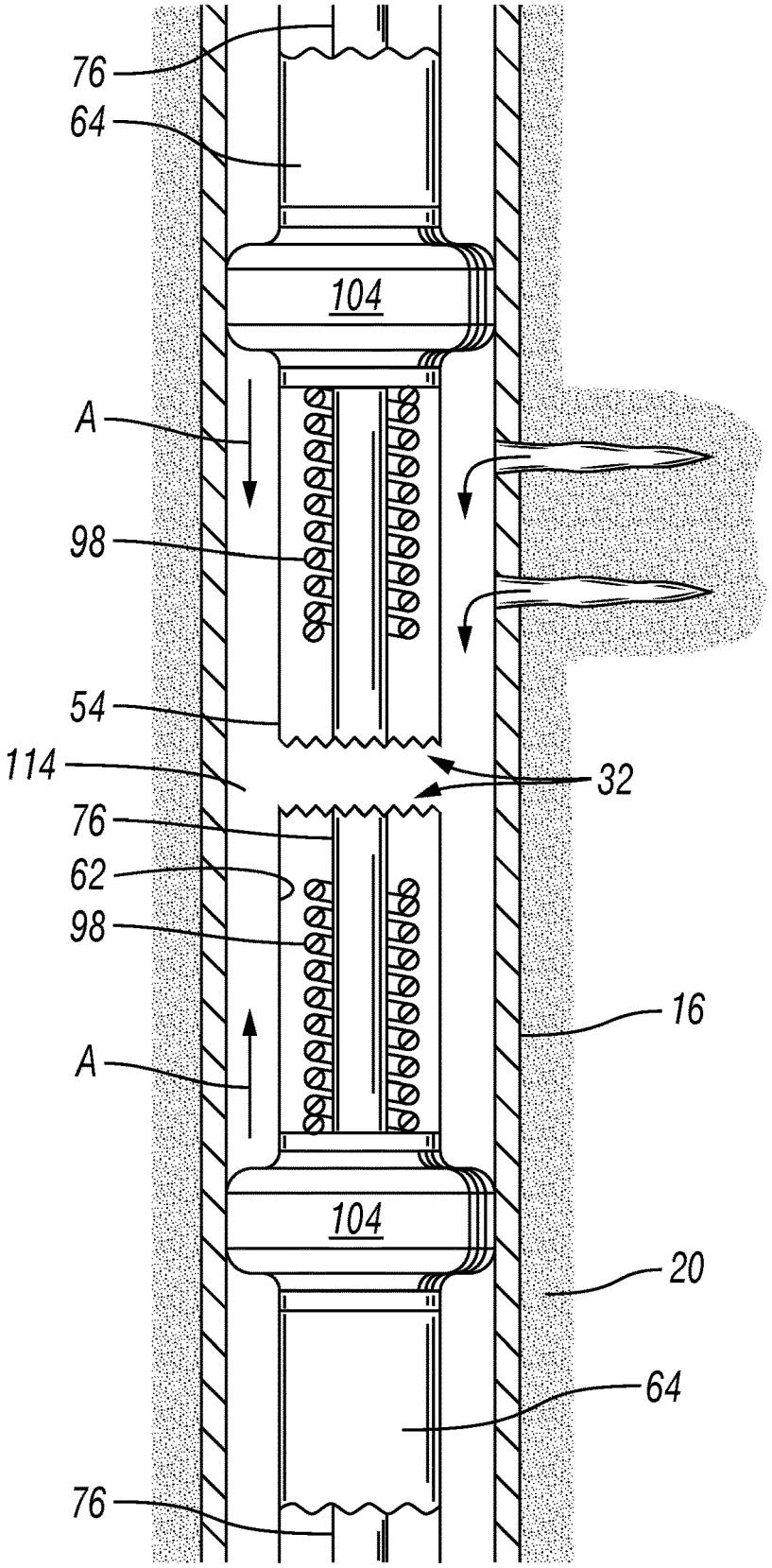
FIG. 5 is a representation of the downhole tool assembly of FIG. 3.

When it is desired to focus an underbalance event in a desired formation zone 33, a well operator actuates the firing head 42, which initiates firing of explosive charges disposed within downhole tool 44. The firing of firing head 42 causes rupturing 112 of the tubular body 54, as shown in FIG. 5, and also ruptures the shear disks 94 which frees the pistons 64 to slide along the mandrels 76. Rupturing the tubular body 54 creates a pressure differential between the higher pressure in wellbore 12 and the lower pressure in the internal chamber 56. This causes the pistons 64 to move quickly along mandrels 76 towards each other in the direction of arrows A shown in FIG. 5 against the relatively weak force of springs 98 which are compressed. At the same time, flexible plug elements 104 are rapidly squeezed or compressed adjacent the ends 68 of the cylinders 62 (FIG. 3) so as to instantaneously deploy and expand the plug elements 104 into temporary plugging engagement with the inside of casing 16. The existing pressure forces maintain the pistons 64 and plug elements 104 in position.

Figure 6:
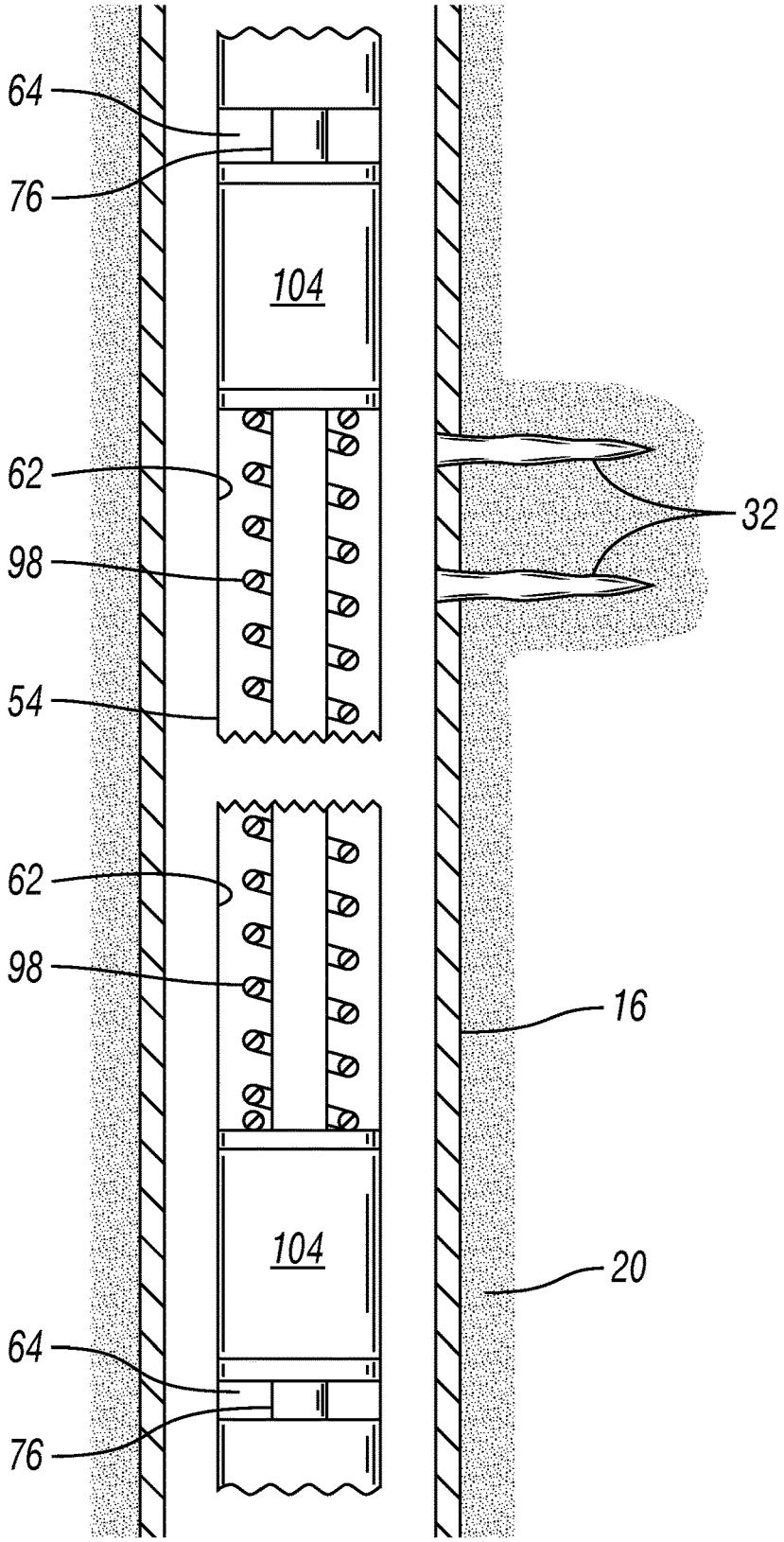
FIG. 6 is a further representation of the downhole tool assembly following a fired condition.

Upon deployment of the plug elements 104, a dynamic underbalance effect created by the pressure differential is initiated resulting in a suction flow of the fluid from the wellbore 12 and debris from the perforation tunnels 32 only from the isolated wellbore zone 114 (FIG. 5) defined by and between the expanded plug elements 104. In the meantime, the low pressure sides of the pistons 64 are flooded with borehole fluid 14 which flows through the exposed ruptured openings 116 (FIG. 3) and the passageways 84 in mandrels 76 equalizing the pressure and allowing the plug elements 104 to return to their original collapsed shape and dimensions. The equalized pressure also allows the compressed springs 98 to assist in returning the plug elements 104 to their original shape as shown in FIG. 6. Upon restoration of the plug elements 104 to their initial condition, the tool 44 filled with fluid and debris is extracted from wellbore 12 such that the cleaned material deposited in the tubular body 54 may be analyzed, if desired.

It should be understood from the above embodiment that the downhole tool assembly 34 creates a transient mechanical plug arrangement that is utilized to focus and control the effect of dynamic underbalance in the wellbore zone 114 temporarily defined by the expanded plug elements 104. Such arrangement disrupts the movement and pressure effects of the borehole fluids outside the wellbore zone 114 towards the area of dynamic underbalance so as to maximize the effect of cleaning of debris from the perforation tunnels 32 in the zone 114. In addition, the transient plug arrangement confines the effect of the explosion occurring in the tubular body 54 to the defined wellbore zone 114.

The above-described downhole tool 44 may be used in some embodiments to perforate a wellbore, the charges projecting a fluidized metallic jet into the rock formation. In other embodiments, the above-described downhole tool 44 may be used to perform remedial work on the formation, shooting "blanks," effectively creating a shock wave that travels into the existing perforations or damaged formation.

In some embodiments, the downhole tool may also include a laser sub assembly 48 (FIG. 1), such as a laser sub assembly described above with respect to FIGS. 7 and 7A. The laser sub assembly 7170 may be disposed intermediate plug assemblies 50, 52 or may be disposed above or below (as illustrated) the plug assemblies 50, 52 in other embodiments. In yet other embodiments, the laser sub assembly 7170 may be disposed between a set of packer or valve assemblies, controlling flow and allowing use of the laser in an underbalanced condition when treating the formation. These various options will be discussed in greater detail below.

As described above with respect to FIGS. 1-6, a perforating gun may be used initially to perforate a formation in an underbalanced condition. The downhole tool may then be moved, aligning the laser assembly 48 with a perforation as described above. The laser may then be used to image and/or remediate the perforation, such as damage caused by the perforating process, may be used to enhance the geometry of the perforation created by the charge (make it wider, deeper, etc.), or other beneficial or remedial operations to enhance communication of reservoir fluids from the formation into the wellbore or the injection of fluids into the surrounding formation.

In other embodiments, a perforating gun may be used initially to perforate a formation in a conventional manner, without underbalance or formation damage mitigation. The downhole tool may then be moved, aligning the laser assembly with a perforation as described above. The laser may then be used to remediate the perforation, such as damage caused by the perforating process, may be used to enhance the geometry of the perforation created by the charge (make it wider, deeper, etc.), or other beneficial or remedial operations to enhance communication of reservoir fluids from the formation into the wellbore or the injection of fluids into the surrounding formation.

In some embodiments, such as when it is desired to use the laser in an underbalanced condition, the laser assembly 48 may be disposed between a set of packers and the laser assembly 48 may include valve assemblies to control the pressure in the packed off region around the laser assembly and to control the flow of formation material into the downhole tool, as well as control of any fluids or gases that may be used in conjunction with the laser for treating the formation. The laser may be positioned proximate a perforation to be treated, as described above. The packers may then be engaged, creating a pressure control zone, and the valve assemblies may be used to generate an underbalanced condition. The laser may then be used, in an underbalanced condition, to remediate the perforation, such as damage caused by the perforating process, may be used to enhance the geometry of the perforation created by the charge (make it wider, deeper, etc.), may be used to loosen perforation tunnel debris material to create a cleaner perforation tunnel, or other beneficial or remedial operations to enhance communication of reservoir fluids from the formation into the wellbore or the injection of fluids into the surrounding formation. During the use of the laser, the valve assemblies may be used to control flow within the underbalanced zone, including flow of formation materials as well as control of any fluids or gases that may be used in conjunction with the laser for treating the formation. For example, controlling the underbalance (wellbore to formation) may be used to enhance the removal of debris.

In other embodiments, the laser assembly may be used to alter a condition of the target formation material, such as to enhance weakening of target material prior to perforation or prior to perforation clean up using a "blank" charge or to alter a character of the formation proximate the wellbore to be more receptive to perforation. For example, the laser assembly 48 may be activated within a target formation zone, altering a condition or character of the formation materials; subsequently, a perforating operation may be performed in the target formation zone, the perforating operation achieving enhanced results due to the pre-treatment of the zone with the laser assembly. Following perforation, the laser assembly 48 may also be used to remediate the perforation, such as damage caused by the perforating process, may be used to enhance the geometry of the perforation created by the charge (make it wider, deeper, etc.), or other beneficial or remedial operations to enhance communication of reservoir fluids from the formation into the wellbore or the injection of fluids into the surrounding formation.

Surface equipment at the wellhead, such as coiled tubing equipment, may be used in conjunction with the valve assemblies to inject gases and fluids during or after treatment of the formation with the laser assembly. For example, injected gases and fluids may be used to enhance debris removal, allow debris to be circulated out while maintaining well control, and may maintain a desired pressure differential between the wellbore fluid pressure and the reservoir formation pore pressure. Additionally, the injection of fluids and gases may be coordinated with the use of the laser, enhancing target material weakening.

As described above, embodiments of the present disclosure may employ the laser assembly in conjunction with various surface equipment located at the wellhead site to allow injected gases and fluids to assist with debris removal. High frequency injection of fluids and gases may be used in a similar manner to assist with debris removal.

In addition, laser assemblies in accordance with embodiments of the present disclosure may be used to plug pre-existing perforations. In such an embodiment, a laser sensitive material (which may be a polymerizable material, or other laser sensitive material) may be disposed in a pre-existing perforation, and then the laser assembly may be employed to selectively solidify the laser sensitive material to plug the holes, as part of an abandonment operation, or as part of a remediation treatment. For example, the laser assembly may be used to initiate reaction of components in a fluid pill, the pill forming a gel, cement or other desired reaction product.

The remediation treatment involves pumping a laser-activatable material to a specific remediation site or sites disposed along a wellbore. In one example, the laser-activatable material comprises a cement matrix having a laser-sensitive material and designed for remedial cementing. The laser-activatable materials are deployed in the cement system to remediate a wellsite by enhancing the ability of the cement to shut off unwanted fluid migration, such as annular fluid migration. In some applications, the cement matrix, including the laser-sensitive materials, is used to shut off the unwanted annular flow of gas, such as shallow gas.

In another embodiment, a laser-activatable material is a fluid that is a vaporizable or expandable fluid. Such a fluid may be pumped into a pre-existing perforation tunnel. Upon heating by the laser, the laser-activatable material may expand or vaporize, creating a pressure gradient to expel debris material from the tunnel, creating a cleaner perforation.

In another embodiment, direct laser sintering of powder or liquid pumped downhole into the perforation tunnel may be employed to transform the powder or liquid from a mobile to immobile state, where it then can perform additional functions, such as acting as a gravel pack. In one example, a granular mixture, such as a high permeability granular mixture, is sintered in place, which allows formation fluids to flow through, but blocks the passage of sand.

In addition, the laser assembly of the present disclosure may be used to geometrically modify perforation tunnels, or to modify the perforation tunnel to allow for debris to pass escape into the wellbore. The fracture path of the formation can be analyzed, as explained with reference to FIG. 8 above, and remedial laser assisted fractures can be used to reduce stresses on the formation, or to otherwise alter the shape of the fractures. For example, perforation tunnel and entrance hole geometry may be enhanced by laser treatment, the treatment designed to reduce fracture breakdown pressure, enhance productivity, or to stabilize the tunnel to minimize sanding propensity. This type of treatment may be performed on the formation as well as the casing and cement.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method for conditioning a wellbore, comprising:

propagating a shock wave through pre-existing perforations extending through a casing and into a formation with a perforating gun by creating the shock wave via firing a blank charge; and treating each of the pre-existing perforations with a laser, subsequent to propagating the shock wave, by cutting a tunnel along each of the pre-existing perforations in a specific, time dependent pattern by moving the laser relative to each pre-existing perforation while cutting the tunnel in each pre-existing perforation, wherein moving the laser comprises oscillating the laser over a defined angular range, and wherein moving the laser comprises oscillating the laser in a first spiral shape moving concentrically outward from a center of the tunnel to a minimum radial dimension, then reversing oscillation of the laser in a second spiral shape moving concentrically inward to return to the center of the tunnel.

2. The method of claim 1, further comprising:

perforating a formation with the perforating gun to create one or more additional perforations in the formation; and treating one or more of the created additional perforations with the laser.

3. The method of claim 2, further comprising treating the formation with the laser prior to perforating or propagating.

4. The method of claim 1, wherein treating comprises at least one of:

making the perforation wider;

making the perforation deeper;

altering a shape of the perforation;

removing debris from the perforation; and altering a character of the formation proximate the wellbore.

5. A method for conditioning a wellbore, comprising:

providing a downhole tool assembly for a perforating gun and a plurality of plug elements;

maintaining the downhole tool assembly along pre-existing perforations extending into a formation along a borehole;

propagating a shockwave through the pre-existing perforations with the perforating gun by creating the shockwave via a blank charge; and treating, subsequent to propagating the shockwave, each of the pre-existing perforations with a laser oscillated over a defined angular range according to a specific, time dependent pattern and coincident with gas injection to assist with debris removal, wherein the laser is oscillated in a first spiral shape moving concentrically outward from a center of the respective pre-existing perforation to a minimum radial dimension, then reversing oscillation of the laser in a second spiral shape moving concentrically inward to return to the center of the respective pre-existing perforation.

6. The method of claim 5, further comprising:

perforating the formation with the perforating gun to create one or more additional perforations in the formation;

treating one or more of the created additional perforations with the laser.

7. The method of claim 6, further comprising treating the formation with the laser prior to creating the one or more additional perforations.

8. The method of claim 5, wherein treating comprises making the pre-existing perforations wider.

9. The method of claim 5, wherein treating comprises making the pre-existing perforations deeper.

10. The method of claim 5, wherein treating comprises altering the shape of the pre-existing perforations.

11. The method of claim 5, wherein treating comprises cleaning material from the pre-existing perforations.

* * * * *